United States Patent [19]

Hailey

[11] Patent Number: 4,618,314

[45] Date of Patent: Oct. 21, 1986

[54] FLUID INJECTION APPARATUS AND METHOD USED BETWEEN A BLOWOUT PREVENTER AND A CHOKE MANIFOLD

[76] Inventor: Charles D. Hailey, 11628 Burning Oaks Rd., Oklahoma City, Okla. 73150

[21] Appl. No.: 670,410

[22] Filed: Nov. 9, 1984

[51] Int. Cl.[4] ..... F04B 21/00; E21B 33/00

[52] U.S. Cl. ..... 417/53; 417/63; 417/401; 166/75.1; 166/90; 285/156

[58] Field of Search ..... 417/53, 63, 313, 401, 417/572; 166/75 R, 90; 251/1 R, 1 A; 285/156

[56] References Cited

U.S. PATENT DOCUMENTS

| | | | |
|---|---|---|---|
| 2,135,770 | 11/1938 | Ritchie | 285/156 |
| 2,287,760 | 6/1942 | Hicks | 417/401 |
| 2,773,551 | 12/1956 | Warden et al. | 166/75 R |
| 2,893,625 | 7/1959 | Greska | 417/572 X |
| 3,621,865 | 11/1971 | Baggaley | 417/401 X |
| 3,804,175 | 4/1974 | Miller | 166/90 X |
| 3,901,313 | 8/1975 | Doniguian et al. | 166/75 X |
| 4,419,056 | 12/1983 | Ege | 417/53 X |

*Primary Examiner*—William L. Freeh
*Assistant Examiner*—Paul F. Neils
*Attorney, Agent, or Firm*—Laney, Dougherty, Hessin & Beavers

[57] ABSTRACT

A fluid injection apparatus includes a portable base frame having a pumping mechanism and fluid container mounted thereon. A conduit connects the pumping mechanism to a spacer flange which can be interconnected between a blowout preventer and a choke manifold so that fluid can be readily injected into these two types of equipment. This apparatus and its interconnection between the blowout preventer and choke manifold provide a technique by which accumulated solid deposits within the blowout preventer can be blown back toward the well to prevent their passage into the choke manifold, thereby preventing blockage of the choke manifold. The apparatus and method of the present invention also permit fluids to be injected into the blowout preventer and choke manifold for such purposes as conducting pressure tests and for preventing freezing of the components of the blowout preventer and choke manifold.

17 Claims, 9 Drawing Figures

FLUID INJECTION APPARATUS AND METHOD USED BETWEEN A BLOWOUT PREVENTER AND A CHOKE MANIFOLD

BACKGROUND OF THE INVENTION

This invention relates generally to fluid injection apparatus and methods used at a well site and more particularly, but not by way of limitation, to portable fluid injection apparatus and methods used between a blowout preventer and a choke manifold.

A blowout preventer and a choke manifold are coupled at a flanged connection as known to the art for uses as also known to the art to control the flow of fluid from a well during drilling, completion and production of the well. To insure that this equipment is in proper working condition, pressure tests need to be performed to determine if the equipment has any leaks. Additionally, anti-freeze fluids, such as methanol, sometimes need to be injected into the equipment to prevent freezing.

To perform such pressure testing and fluid injecting operations, it is known that a pump of any suitable type commonly found at a well site can be connected to the top of the blowout preventer or wellhead or to the manifold riser of the choke manifold for injecting fluid used either to perform pressure tests or to provide anti-freeze protection. In performing these operations, the pump equipment is connected during the fluid injection periods and then disconnected thereafter so that the blowout preventer and choke manifold can be properly operated during the drilling, completion or production of the well. Therefore, any time additional fluid needs to be injected, such as to recharge a choke manifold with anti-freeze fluid, the drilling, completion or production operation must be terminated and the injection pumping equipment must be reconnected.

It is also known that when production fluid is flowing from the well and through the blowout preventer, build-ups of a solid residue, known as "bar plugs," occur in the choke line of the blowout preventer. Bar plugs are formed from cuttings, shale, mud and the like found in the fluid which flows from the well and out of the blowout preventer during drilling. Bar plugs present a problem in the operation of the blowout preventer and connected choke manifold because they can move through the outlet of the choke line of the blowout preventer into the connected choke manifold, thereby clogging the choke manifold and preventing proper operation thereof. Because I am not aware of any present apparatus or method which is used to prevent bar plugs from flowing into choke manifolds, there is the need for some type of apparatus and method which can be used with a blowout preventer and connected choke manifold for preventing bar plugs from passing into the choke manifold.

To enhance the utility of such an apparatus and method, it is also desirable for such an apparatus and method to be capable of flowing fluid into the connected blowout preventer and choke manifold to perform pressure tests and to introduce anti-freeze fluid into this equipment. This flow of fluid should be readily repeatable without requiring reconnection and without requiring termination of the normal operation of the blowout preventer and choke manifold. This is desirable because, for example, during certain times continual or repeated flows of anti-freeze fluid are needed to prevent or reduce the formation of hydrates within the equipment, which hydrates freeze and clog the equipment. For example, when a gas zone is encountered and gas is vented or flows from the zone and into the blowout preventor and choke manifold, the flow of the gas "bubble" may continue for a long time, such as for more than an hour. During this time the aforementioned undesirable hydrates can condense from the "bubble" and clog the equipment. This hydrate formation can be prevented or reduced by continually or repeatedly introducing an anti-freeze fluid, such as methanol, into the blowout preventer and choke manifold; a single injection of the anti-freeze fluid prior to the flow of the gas will not suffice because it will flow out of the equipment along with the flow of gas.

SUMMARY OF THE INVENTION

The present invention provides an apparatus and a method which meet the above-noted needs. The apparatus and method prevent bar plugs from passing from a blowout preventer to a connected choke manifold. The present invention also allows pressure tests to be performed on the equipment. The injection of any suitable type of fluid, such as methanol for anti-freeze protection, can be accomplished with the present invention, even during normal operation of the blowout preventer and choke manifold.

Broadly, the apparatus of the present invention includes a portable base frame on which are mounted both a fluid container means for receiving the fluid to be pumped into the blowout preventer and choke manifold and a pump means for pumping the fluid of the fluid container means through an outlet of the pump means. The apparatus also includes spacer flange coupling means, connectible between the blowout preventer and choke manifold, for coupling the outlet of the pump means with the blowout preventer and choke manifold. The spacer flange coupling means includes a flange body having a longitudinal opening defined therethrough for providing a flow path in line with the connected blowout preventer and choke manifold. The flange body has a lateral port defined therein so that it extends outwardly from the longitudinal opening to an exterior surface of the flange body. The spacer flange coupling means also includes conduit means for providing a flow conductor between the outlet of the pump and the lateral port of the flange body.

The method of the present invention broadly includes connecting flow port means for providing a fluid communication path between an outlet of a blowout preventer and an inlet of a choke manifold and for providing an injection port into the fluid communication path. The method also includes flowing a fluid into the injection port so that the fluid is dispersed through the fluid communication path towards both the blowout preventer and the choke manifold. The method also comprises the steps of closing a first valve means disposed in the blowout preventer and a second valve means disposed in the choke manifold before flowing the fluid into the fluid communication path, and the step of opening the first valve means after the step of flowing the fluid. This opening step is generally conducted after the fluid has been flowed into the fluid communication path between the closed first and second valve means until the fluid therein is pressurized to a pressure greater than the pressure within the blowout preventer between the well to which the blowout preventer is connected and the first valve means of the blowout preventer. In the preferred embodiment, the fluid includes methanol for preventing freezing in the choke manifold.

Therefore, from the foregoing, it is a general object of the present invention to provide a novel and improved fluid injection apparatus and method for use at a well site, particularly for injecting a fluid into a blowout preventer and a connected choke manifold. Other and further objects, features and advantages of the present invention will be readily apparent to those skilled in the art when the following description of the preferred embodiment is read in conjunction with the accompanying drawings.

BRIEF DESCRIPTION OF THE DRAWINGS

FIG. 5 is a first side view of the injector apparatus of the preferred embodiment of the present invention.

DETAILED DESCRIPTION OF THE PREFERRED EMBODIMENT

Figure 1:
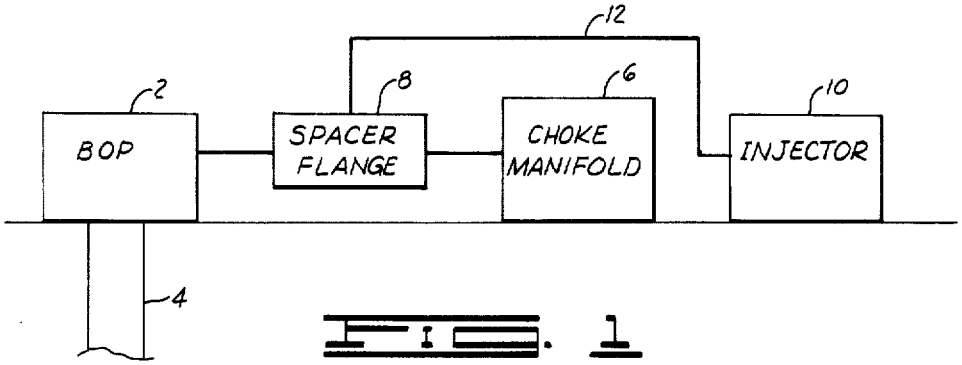
FIG. 1 is a block diagram of the present invention associated with a blowout preventer and choke manifold.

FIG. 1 is a block diagram showing the present invention associated with a blowout preventer 2, connected to a well 4 as known to the art, and a choke manifold 6. FIG. 1 shows that the present invention includes a spacer flange 8 interconnecting the blowout preventer 2 in fluid communication with the choke manifold 6. Also included in the present invention is an injector apparatus 10 connected to the spacer flange 8 by means of a suitable conduit means 12.

The blowout preventer 2 is of any suitable type as known to the art for connecting to the top of the well 4 and for receiving a flow of production fluid therefrom in a manner as known to the art. The term "production fluid" is used herein to mean whatever fluid may flow into the blowout preventer 2 from the well 4 as known to the art.

Figure 2:
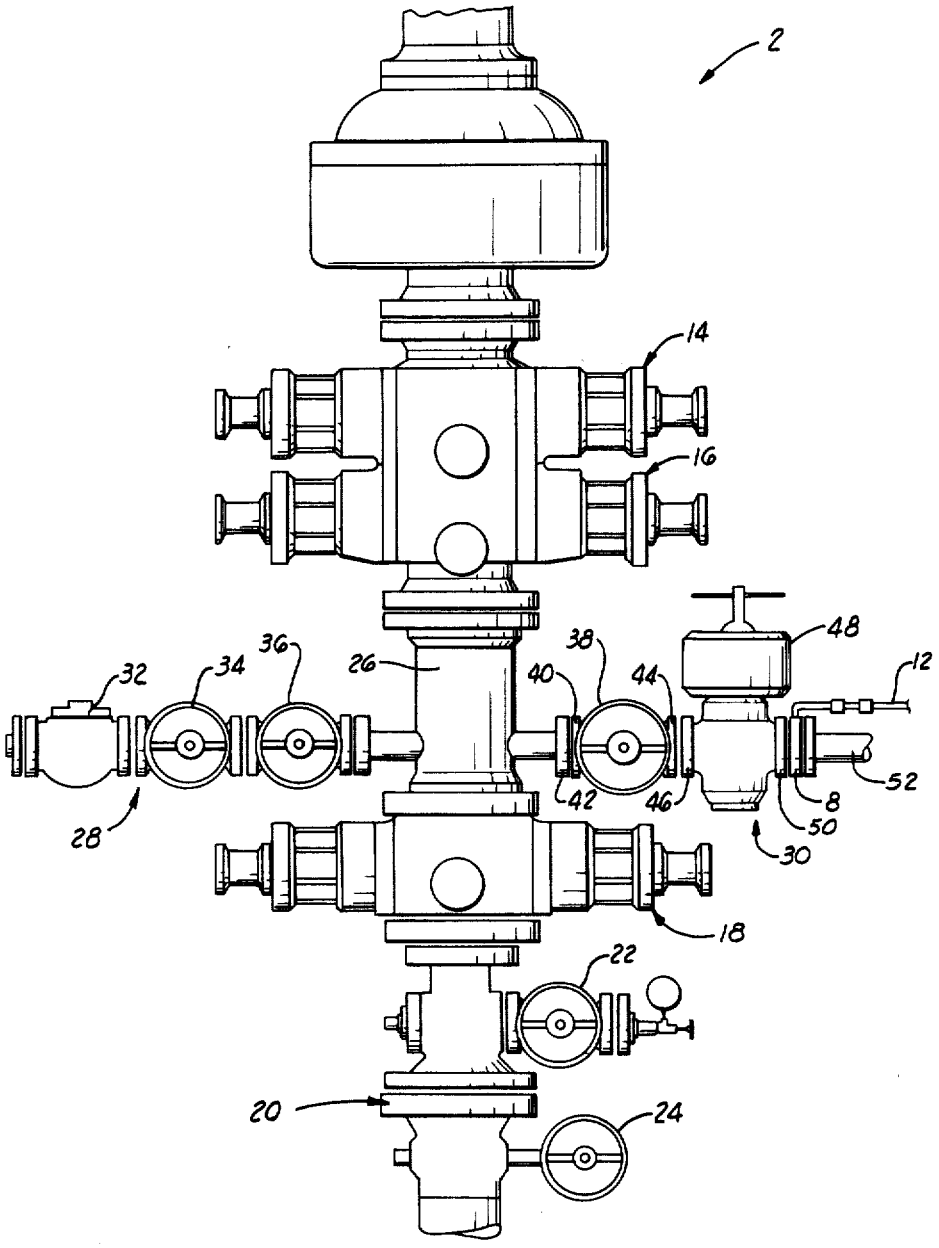
FIG. 2 is an elevational view of a blowout preventer having a spacer flange of the preferred embodiment of the present invention connected thereto.

Although the blowout preventer 2 may be of any suitable type as known to the art, one specific embodiment of the blowout preventer 2 is illustrated in FIG. 2. The blowout preventer 2 illustrated in FIG. 2 includes a top ram 14 connected adjacent a middle ram 16 in a manner as known to the art. It is to the top ram 14 that I have seen other pumping systems connected for purposes of conducting pressure tests on the blowout preventer. The blowout preventer 2 also includes a bottom ram 18. The bottom ram 18 is connected to the well 4 through coupling arm members 20 having valves 22, 24 associated therewith as known to the art.

Interconnecting the two uppermost rams 14, 16 with the lowermost ram 18 is a connector sleeve 26 from which a fill line 28 and a choke flow line 30 extend.

The kill line 28 includes a check valve 32 connected in series with two manual valves 34, 36 as known to the art.

The choke flow line 30 connects with the choke manifold 6 and includes a manual valve 38 connected by means of a flange 40 to a flanged stub 42 protruding from the connector sleeve 26. At the other end of the valve 38 is another flange 44 which is connected to a flanged inlet 46 of a hydraulic control valve 48. The valve 48 has an outlet defined through a flanged end 50. The flanged end 50 provides the outlet of the choke flow line 30 of the blowout preventer 2, which outlet is normally directly connected to the choke manifold 6 by means of a flanged pipe coupling 52. However, in the preferred embodiment of the present invention, the flanged outlet 50 is connected to the pipe coupling 52 through the spacer flange 8 having the conduit means 12 extending therefrom.

During oepration of the blowout preventer 2, production fluid from the well 4 enters through the coupling members 20 and the lowermost ram 18. The production fluid flow continues vertically through the blowout preventer with side streams splitting off in the connector sleeve 26 to flow through the kill line 28 or the choke flow line 30 if the valves 34, 36 or the valves 38, 48, respectively, are open. As the production fluid branches into the choke flow line 30, cuttings, shale, mud or other solids in the production fluid flow accumulate within the flanged stub 42 of the choke line of the blowout preventer 2, for example. As these deposits accumulate, bar plugs are formed. These bar plugs can then flow on through the choke flow line 30 and into the choke manifold 6 when the valves 38, 48 are open.

Figure 3:
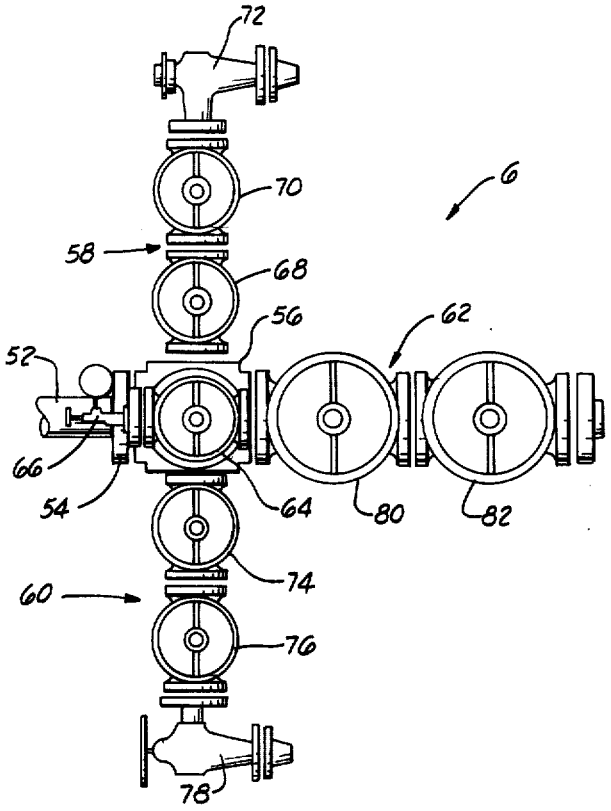
FIG. 3 is a plan view of a choke manifold.
Figure 4:
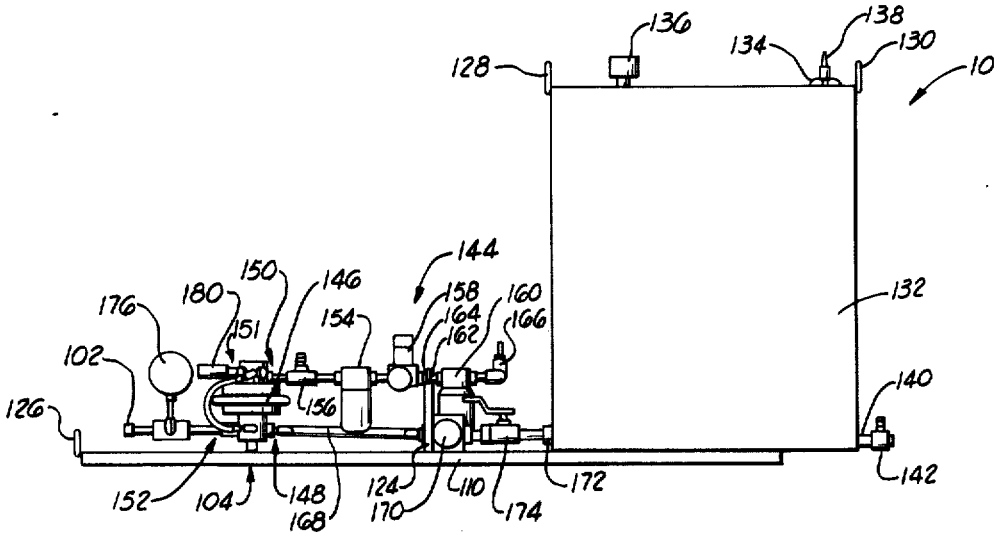
Figure 6:
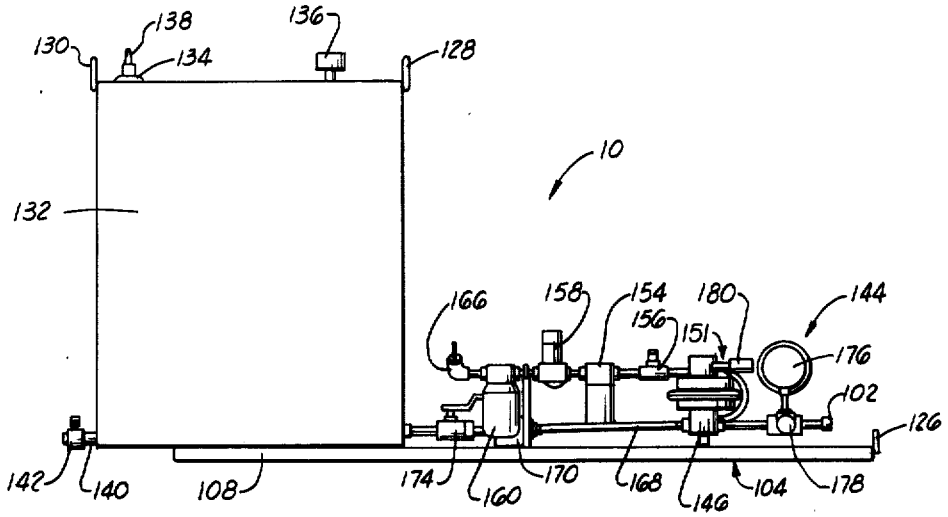
FIG. 6 is a second side view, taken opposite the view shown in FIG. 5, of the injector apparatus of the preferred embodiment of the present invention.
Figure 7:
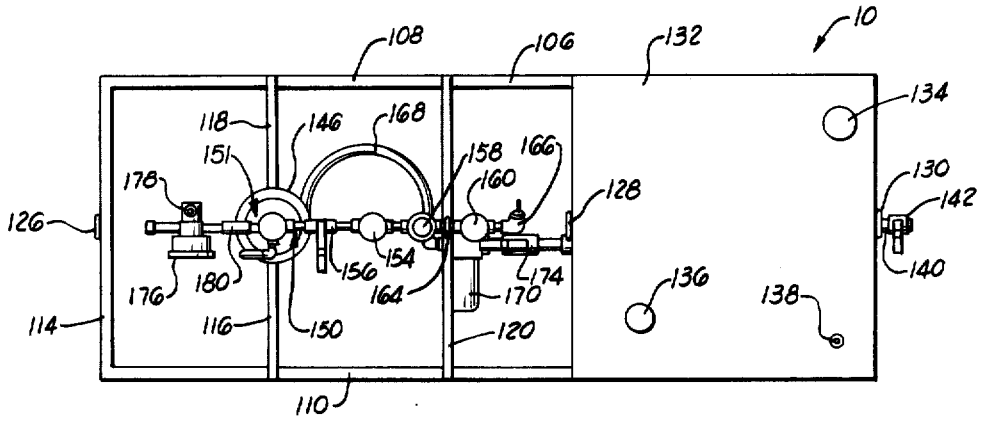
FIG. 7 is a top view of the injector apparatus of the preferred embodiment of the present invention.
Figure 8:
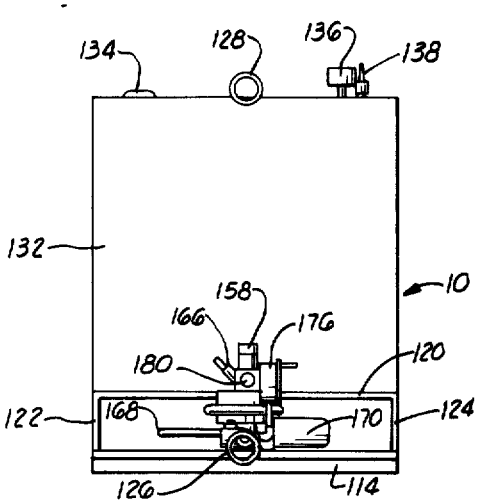
FIG. 8 is an end view of the injector apparatus of the preferred embodiment of the present invention.
Figure 9:
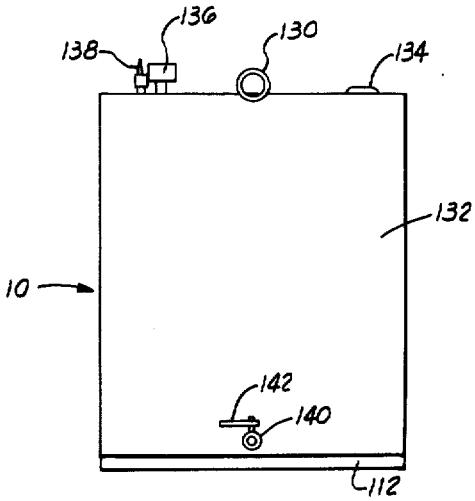
FIG. 9 is another end view, taken opposite the view shown in FIG. 8, of the injector apparatus of the preferred embodiment of the present invention.

Although choke manifolds of various types are susceptible of receiving bar plugs, a specific embodiment of the choke manifold 6 is illustrated in FIG. 3. The choke manifold 6 shown in FIG. 3. receives the fluid flow from the conduit 52 to which the choke manifold 6 is connected at a flange 54. The flange 54 is connected to a multi-ported joint member 56 having four side openings and one top opening. One of the side openings is connected to the conduit 52; another of the side openings is connected to a positive choke branch 58; another of the side openings is connected to an adjustable choke branch 60; the fourth opening is connected to a main flow branch 62. The top opening is connected to a manifold riser, which includes a valve 64 and has a gauge 66 connected thereto. I am aware of prior art pumping apparatus which have been connected to the manifold riser 64 in place of the gauge 66 for pumping fluid into the choke manifold and back into the blowout preventer through the conduit 52 for pressure testing the blowout preventer and for charging the equipment with anti-freeze fluid.

The positive choke branch 58 includes two serially connected manual valves 68, 70. A preset positive choke 72 is connected to the outlet of the valve 70 as known to the art.

The adjustable choke branch 60 includes two serially connected manual valves 74, 76 having an adjustable choke 78 connected therewith as known to the art. The adjustable choke 78 is locally or remotely controllable as also known to the art.

The main flow branch 62 includes two serially connected valves 80, 82 as known to the art.

Figure 4:
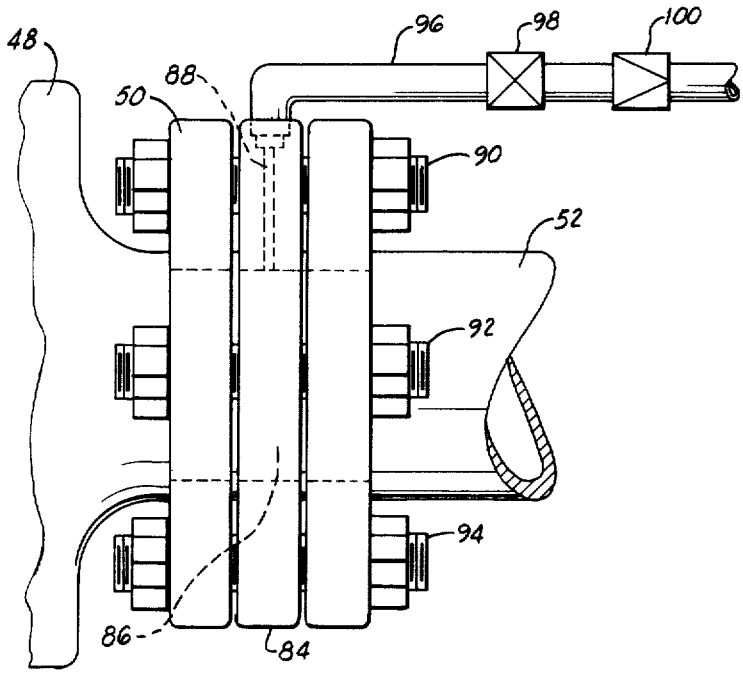
FIG. 4 is an enlarged view of the spacer flange interconnecting the blowout preventer and the choke manifold.

As previously mentioned, in the present invention the blowout preventer 2 and the choke manifold 6 are connected in fluid communication with each other through the spacer flange 8. The preferred embodiment of the spacer flange 8 is shown in FIG. 4. The spacer flange 8 includes a circular flange body 84 having a longitudinal opening 86 defining a flow passageway or fluid communication path therethrough. Extending laterally or transversely (specifically, radially in the preferred embodiment) from the passageway 86 is a port 88 which communicates the opening 86 with the circumferential exterior surface of the flange body 84. The flange body 84 also has suitable openings defined through the periphery thereof for receiving connector bolts such as those identified in FIG. 4 by the reference numerals 90, 92, 94.

Threadedly connected to the port 88 at an internally threaded receptacle recessed below the circumferential exterior surface of the flange body 84 is the conduit means 12, which in the preferred embodiment includes either a flexible or rigid hose or pipe 96 having a needle valve 98 and a check valve 100 disposed serially therein. The hose or pipe 96 extends to the injector apparatus 10 for coupling a suitable connector 102 as shown in FIG. 5, for example.

The preferred embodiment of the injector apparatus 10 of the present invention is illustrated in FIGS. 5–9. These drawings show that the preferred embodiment includes a portable base frame 104 having an outer framework 106 of rectangular shape. The outer framework 106 is defined by two spaced, parallel longitudinal rails or beams 108, 110 interconnected at one end by a cross rail or beam 112 and at the other end by a cross rail or beam 114.

Connected across the outer framework 106 between the longitudinal members 108, 110 and parallel to the end members 112, 114 is a support member 116 disposed at a vertical orientation relative to the outer framework 106. In the preferred embodiment this vertical orientation is established by connecting the support member 116 so that a top surface 118 of the support member 116 is spaced above the upper surface of the members 108, 110 by only the height of the rail or beam defining the support member 116.

Extending across the outer framework 106 between the members 108, 110 is another support member defined by a cross piece 120 supported on upstanding leg members 122, 124. The cross piece 120 is spaced from and parallel to the support member 116. The cross piece 120 is closer to the end member 112 than is the support member 116, and the support member 116 is closer to the end member 114 than is the cross piece 120. The cross piece 120 is disposed at a different vertical orientation above the outer framework 106 than is the support member 116. This vertical orientation is defined by the length of the legs 122, 124.

Forming another part of the portable base frame 104 is a lifter connector means for enabling the injector apparatus 10 to be lifted and moved at the well site by winches or other suitable lifting mechanisms. In the preferred embodiment the lifter connector means includes a plurality of retaining rings. One of the retaining rings is identified by the reference numeral 126 shown welded to the end member 114. The lifter connector means also includes two other retaining rings 128, 130 which are connected to a fluid container means of the preferred embodiment of the injector apparatus 10.

The fluid container means of the preferred embodiment includes a housing 132 mounted at the end of the portable base frame 104 overlying the end member 112 so that a portion of the housing 132 extends beyond the end of the base frame 104. A suitable fluid receptacle (not shown) is contained within the housing 132. This receptacle communicates with a fill line closed by a fill cap 134 located on the top of the housing 132. The receptacle also communicates with a vapor vent 136 and a gauge stick 138, both of which are also located on the top of the housing 132. In the preferred embodiment the gauge stick 138 has a non-spark rod which extends into the fluid receptacle for determining the quantity of fluid retained therein. The receptacle also communicates with a drain line 140 having a valve 142 disposed therein. The drain line 140 and the valve 142 extend from the end side wall of the housing 132 which is spaced beyond the end of the base frame 104. In the preferred embodiment the fluid container contains methanol which is used to prevent the formation of hydrates, and thus to prevent freezing, when it is injected into the blowout preventer 2 or the choke manifold 6 through the conduit means 12 and the spacer flange 8.

This injection of the fluid into the blowout preventer 2 or the choke manifold 6 is achieved through the operation of a pump means 144 of the preferred embodiment of the injector apparatus 10. The pump means of the preferred embodiment includes a pneumatic pump 146 of a type as known to the art. The pump 146 has a flow inlet or pump intake 148, a drive inlet 150, a drive outlet 151 and a flow or pump outlet 152. The pneumatic pump 146 is mounted on the support member 116 so that the drive inlet 150 is oriented above the flow inlet or pump intake 148.

The pump means also includes an oil lubricator means 154 of a type as known to the art. The outlet of the oil lubricator means 154 is connected to the drive inlet 150 through a manual valve 156.

The pump means also includes an air flow regulator means 158 of a type as known to the art. The outlet of the air flow regulator means 158 is connected to the inlet of the oil lubricator means 154. The air flow regulator means 158 is preset as known to the art to the air flow rate desired for operating the pneumatic pump 146.

Connected to the air flow regulator means 158 is an air filter means 160 of a type as known to the art. The outlet of the air filter means 160 is connected to the inlet of the air flow regulator means 158 by means of a connector sleeve 162 which is retained on top of the support member 120 by a U-shaped bolt or retaining collar 164. Extending from the inlet of the air filter means 160 is a suitable connector means 166 for connecting the air filter means 160 to a source of pressurized air (not shown) as known to the art.

The pump means also includes means for connecting the flow inlet 48 to the fluid receptacle within the housing 132. The preferred embodiment of this connecting means includes a flexible hose 168 connected between the inlet 148 and an outlet of a fluid filter 170 of a type as known to the art. Connected between the inlet of the fluid filter 170 and an outlet 172 of the housing 132 is a manual valve 174.

The injector apparatus 10 of the preferred embodiment also includes a pressure gauge 176 of a type as known to the art. The pressure gauge 176 is connected between the outlet 152 of the pump 146 and the connector 102. Associated with the outlet line in which the gauge 176 is connected is a needle valve 178 of a type as known to the art for providing a pressure release vent to the atmosphere.

The injector apparatus 10 still further includes a muffler 180 of a type as known to the art connected to the drive outlet 151 of the pump 146.

In using the spacer flange 8, injector apparatus 10 and conduit means 12 of the present invention in accordance with the preferred embodiment method thereof, the spacer flange 8 is connected to the flanged connectors of the blowout preventer 2 and the choke manifold 6 in line between the valves 38, 48 of the blowout preventer 2 and the valves of the choke manifold 6. This provides a fluid communication path between the blowout preventer 2 and the choke manifold 6 through the spacer flange 8 and the conduit 52.

The conduit means 12 is connected between the port 88 of the spacer flange 8 and the outlet of the pump 146 at the connector 102.

With these three elements of the present invention interconnected, the fluid contained in the receptacle of the housing 132 is flowed (specifically, pumped in the illustrated embodiment) into the injection port 88 of the spacer flange 8 so that the fluid is dispersed through the fluid communication path in two concurrently flowing streams toward the blowout preventer 2 and the choke manifold 6. This dispersion is specifically toward the valves 48, 38 of the blowout preventer 2 and toward the valves of the choke manifold 6 extending from the various ports of the joint member 56.

To perform pressure tests or inject fluid such as methanol into the blowout preventer 2 and the choke manifold 6, the various rams and valves are opened or closed as needed and then the pump 146 is actuated to pump fluid into the spacer flange 8 for dispersion through the variously opened valves.

To specifically utilize the present invention to overcome the bar plug problem created when solid deposits accumulate in the blowout preventer between the well 4 and the valve 38 (for example, within the flanged stub 42), the present invention is utilized by making the aforementioned interconnections and by also closing the valve 38 of the blowout preventer 2 and the valves 64, 68, 74 and 80 of the choke manifold 6 prior to flowing fluid into the injection port 88 of the spacer flange 8. Once these valves are closed, the fluid in the receptacle of the fluid container housing 132 is flowed into the injection port by actuating the pump 146. The fluid is flowed until the pressure, as indicated on the gauge 176, within the blowout preventer 2, the choke manifold 6 and the conduit 52 between the closed valves thereof exceeds the pressure of the production fluid within the blowout preventer 2 between the well 4 and the other side of the closed valve 38. Once this pressure is attained, the valve 38 is opened whereupon the more highly pressurized fluid injected from the injector apparatus 10 flows into the blowout preventer 2 and drives the bar plugs accumulated therein out of the choke line. Once the bar plugs have been removed, the valves of the choke manifold 6 can be opened in the manner known to the art, such as by first opening the adjustable choke branch 60 followed by the opening of the positive choke branch 58 and the main flow line 62.

To actuate the pump 146, a suitable pressurized air source of a type as known to the art is attached at the connector 166 and the valve 156 is opened. Air from the air source will then flow in accordance with the setting of the air regulator means 158 to drive the pneumatic pump 146. Before the pump 146 is actuated in this manner, the valve 174 should be opened so that fluid can be drawn from the receptacle within the housing 132 through the valve 174, the fluid filter 170, and the flexible hose 168. This fluid is then pumped through the pump outlet 152 and the connector 102 for communication via the conduit means 12 to the spacer flange 8.

Because the injector apparatus 10 is readily portable in view of the aforementioned construction thereof, the present invention is easily usable at different well sites and at different locations within a well site. Additionally, by using the spacer flange 8 connected directly in line between the blowout preventer 2 and the choke manifold 6, the present invention can be continually or repeatedly used without interrupting the normal operation of the blowout preventer 2 or the choke manifold 6 and without requiring any reconnections to be made from one use to the next. Still further, the present invention not only allows for the general injection of fluids, such as for performing pressure tests and anti-freeze injections accomplished heretofore by other types of equipment, but it also provides an apparatus and method for removing or dispersing bar plugs through the blowout preventer, thereby preventing their passage into the choke manifold.

Thus, the present invention is well adapted to carry out the objects and attain the ends and advantages mentioned above as well as those inherent therein. While a preferred embodiment of the present invention has been described for the purpose of this disclosure, numerous changes in the construction and arrangement of parts can be made by those skilled in the art, which changes are encompassed within the spirit of this invention as defined by the appended claims.

What is claimed is:

1. An apparatus for pumping fluid into a blowout preventer through a first opening thereof and into a choke manifold through a second opening thereof, said apparatus comprising:
   - a base frame;
   - fluid container means, mounted on said base frame, for receiving the fluid to be pumped into said blowout preventer and said choke manifold;
   - pump means, mounted on said base frame, for pumping said fluid of said fluid container means through a flow inlet and an outlet of said pump means; and
   - spacer flange coupling means, connectible between said first and second openings, for coupling said outlet of said pump means with said blowout preventer and said choke manifold, said spacer flange coupling means including:
     - a flange body having a longitudinal opening defined therethrough for providing a flow path in line with said first and second openings, said flange body also having a lateral port defined therein outwardly from said longitudinal opening to an exterior surface of said flange body; and
     - conduit means for providing a flow conductor between said outlet of said pump and said lateral port of said flange body.

2. The apparatus of claim 1, wherein said pump means includes:
   - a pneumatic pump having said flow inlet, a drive inlet, and said outlet;
   - lubricator means connected to said drive inlet; air flow regulator means connected to said lubricator means;

air filter means connected to said air flow regulator means; and connector means for connecting said air filter means to a source of pressurized air for driving said pneumatic pump; and means for connecting said flow inlet to said fluid container means.

3. The apparatus of claim 2, wherein:

said base frame includes:

an outer framework, having a first end and a second end;

a first support member connected to said outer framework at a first vertical orientation therewith;

a second support member connected to said outer framework at a second vertical orientation therewith, said second vertical orientation higher than said first vertical orientation; and lifter connector means, connected to said outer framework, for coupling with a mechanism capable of lifting said apparatus;

said pneumatic pump is mounted on said first support member so that said drive inlet is oriented above said flow inlet; and said air filter means is supported by said second support member adjacent said air regulator means.

4. The apparatus of claim 1, wherein said conduit means includes:

a flexible hose connected between said outlet of said pump means and said lateral port of said flange body; and valve means, disposed in line with said flexible hose, for controlling the flow of fluid through said flexible hose.

5. The apparatus of claim 4, further comprising pressure gauge means, connected to said outlet of said pump means, for indicating the pressure of the fluid flowing through said flexible hose.

6. The apparatus of claim 5, wherein said pump means includes:

a pneumatic pump having said flow inlet, a drive inlet, and said outlet;

lubricator means connected to said drive inlet;

air flow regulator means connected to said lubricator means;

air filter means connected to said air flow regulator means; and connector means for connecting said air filter means to a source of pressurized air for driving said pneumatic pump; and means for connecting said flow inlet to said fluid container means.

7. The apparatus of claim 6, wherein:

said base frame includes:

an outer framework, having a first end and a second end;

a first support member connected to said outer framework at a first vertical orientation therewith;

a second support member connected to said outer framework at a second vertical orientation therewith, said second vertical orientation higher than said first vertical orientation; and lifter connector means, connected to said outer framework, for coupling with a mechanism capable of lifting said apparatus;

said pneumatic pump is mounted on said first support member so that said drive inlet is oriented above said flow inlet; and said air filter means is supported by said second support member adjacent said air regulator means.

8. The apparatus of claim 7, wherein:

said fluid container means includes a housing mounted on said outer framework at said first end thereof; and said lifter connector means includes a first retaining ring connected to said housing and a second retaining ring connected to said second end of said outer framework.

9. A method of injecting a fluid into a blowout preventer, connected to a well and having first valve means disposed within a choke flow line extending from said blowout preventer, and into a choke manifold, having second valve means disposed between an inlet adapted for connecting to said choke flow line and an outlet of said choke manifold, said method comprising the steps of:

connecting to said choke flow line and said inlet, between said first and second valve means, flow port means for providing a fluid communication path between said choke flow line of said blowout preventer and said inlet of said choke manifold and for providing an injection port into said fluid communication path; and pumping said fluid into said injection port so that said fluid is dispersed through said fluid communication path towards said first and second valve means.

10. The method of claim 9, wherein said fluid includes methanol for preventing freezing in said choke manifold.

11. The method of claim 9, further comprising the steps of:

closing said first and second valve means before said step of pumping said fluid; and opening said first valve means after said step of pumping said fluid.

12. The method of claim 11, wherein said step of pumping said fluid includes providing in said fluid communication path a pressurized fluid having a pressure greater than the pressure within said blowout preventer between said well and said first valve means.

13. The method of claim 12, wherein said fluid includes methanol.

14. A method of injecting a fluid toward a blowout preventer and a choke manifold which are connected to each other at a flanged connection for receiving a flow of production fluid from a well to which said blowout preventer is connected, said method comprising the steps of:

placing pump means and fluid container means near said blowout preventer and said choke manifold;

installing a spacer flange in said flanged connection so that said spacer flange is interconnected between said blowout preventer and said choke manifold, said spacer flange having a flow passageway defined therethrough for communicating said blowout preventer with said choke manifold and said spacer flange having a port defined therein in communication with said flow passageway;

connecting said pump means in fluid communication with said port of said spacer flange; and actuating said pump means for pumping a fluid from said fluid container means into said flow passageway of said spacer flange so that said fluid flow is split into two concurrently flowing streams, one of said streams flowing toward said blowout preventer and the other of said flows flowing toward said choke manifold.

15. The method of claim 14, wherein:

said fluid container means has methanol contained therein; and said step of actuating said pump means includes pumping said methanol into said flow passageway of said spacer flange while said production fluid is flowing therethrough so that said methanol flows through said choke manifold to prevent freezing therein.

16. The method of claim 14, wherein:

said blowout preventer includes first valve means disposed in line between said well and said spacer flange;

said choke manifold includes second valve means disposed in line with said flow passageway of said spacer flange;

said method further comprises, before said step of actuating said pump means, the steps of: closing said first valve means so that said production fluid does not flow through said flow passageway of said spacer flange; and closing said second valve means;

said step of actuating said pump means includes pumping said fluid into said spacer flange and between said closed first and second valve means until said fluid is pressurized to a pressure greater than the pressure of said production fluid from said well; and said method further comprises, after said step of actuating said pump means, the step of opening said first valve means so that said pressurized fluid flows from between said closed first and second valve means past said opened first valve means and into said blowout preventer.

17. The method of claim 14, wherein:

said blowout preventer includes first valve means for controlling the flow of said production fluid from said blowout preventer into said choke manifold, said production fluid including solid material which tends to form a plug in said blowout preventer between said well and said first valve means;

said choke manifold includes second valve means for controlling the flow of fluid through said choke manifold;

said method further comprises, before the step of actuating said pump means, the steps of: closing said first valve means; and closing said second valve means;

said step of actuating said pump means includes pressurizing said fluid to a pressure greater than the pressure of said production fluid; and said method further comprises, after said step of pressurizing said fluid, the step of opening said first valve means so that said pressurized fluid flows therethrough for preventing said plug of solid material from flowing into said choke manifold.

* * * * *

UNITED STATES PATENT AND TRADEMARK OFFICE

CERTIFICATE OF CORRECTION

PATENT NO. : 4,618,314

DATED : October 21, 1986

INVENTOR(S) : Charles D. Hailey

It is certified that error appears in the above-identified patent and that said Letters Patent is hereby corrected as shown below:

Column 4, line 3, change "fill" to --kill--

Column 6, line 58, change "48" to --148--.

Signed and Sealed this

Tenth Day of March, 1987

*Attest:*

DONALD J. QUIGG

*Attesting Officer*

*Commissioner of Patents and Trademarks*